United States Patent [19]

Newman et al.

[11] 4,351,702

[45] Sep. 28, 1982

[54] PROCESSING OF HEAVY HIGH-SULFUR FEEDSTOCKS

[75] Inventors: Bruce A. Newman; Lyndon D. Boyer, both of Ponca City, Okla.

[73] Assignee: Conoco Inc., Ponca City, Okla.

[21] Appl. No.: 299,747

[22] Filed: Sep. 8, 1981

[51] Int. Cl.[3] ..... C10B 55/04; C10B 57/00; C10B 57/02

[52] U.S. Cl. ..... 201/5; 201/17; 201/22; 201/23; 201/28; 201/30; 201/33; 208/50; 208/53; 208/78

[58] Field of Search ..... 201/5, 17, 26, 28, 30, 201/33, 34, 22, 23; 208/50, 53, 78

[56] References Cited

U.S. PATENT DOCUMENTS

| | | | |
|---|---|---|---|
| 2,511,709 | 6/1950 | Hemminger | 201/5 |
| 3,073,751 | 1/1963 | Gorin et al. | 202/26 |
| 3,117,918 | 1/1964 | Batchelor et al. | 202/26 |
| 3,130,133 | 4/1964 | Loevenstein | 201/17 |
| 3,617,480 | 11/1971 | Keel | 208/53 |
| 3,723,291 | 3/1973 | Thakker | 201/17 |
| 4,203,960 | 5/1980 | Bauer et al. | 201/17 |
| 4,218,288 | 8/1980 | Theodore | 201/33 |
| 4,251,323 | 2/1981 | Smith | 201/34 |

*Primary Examiner*—Bradley Garris
*Attorney, Agent, or Firm*—Richard W. Collins

[57] ABSTRACT

A heavy high-sulfur hydrocarbonaceous feedstock is partially delayed coked and partially formcoked. The coke products are screened, with larger particles being calcined at desulfurizing temperatures and smaller particles being recycled to the formcoker. Overhead products from both coking operations are combined, fractionated, and desulfurized. The heaviest cut from the fractionator is combined with the feedstock as recycle.

5 Claims, 1 Drawing Figure

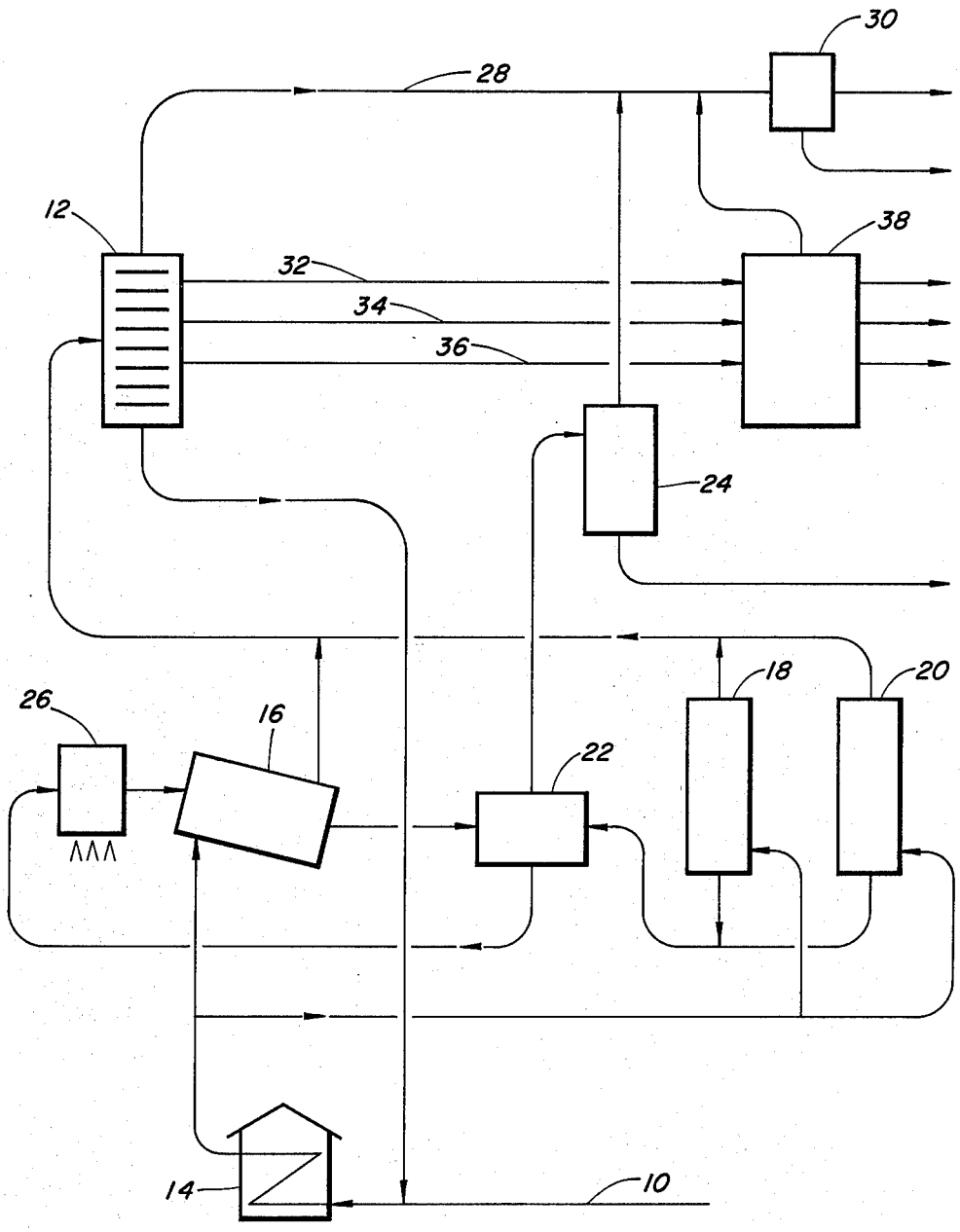
30
28
12
38
32
34
36
24
18
20
26
16
22
14
10

PROCESSING OF HEAVY HIGH-SULFUR FEEDSTOCKS

BACKGROUND OF THE INVENTION

1. Field of the Invention

This invention relates to a process for upgrading heavy high-sulfur hydrocarbonaceous materials, and more particularly to a process for making coke suitable for use as metallurgical coke from a low grade feedstock. The invention further provides for obtaining low-sulfur liquids and gases as additional products.

As the world's supply of high quality petroleum diminishes, there is an increasing interest in processes capable of handling the lower quality hydrocarbon sources. Many hydrocarbon reserves presently available or about to be available are of such low quality that they cannot be processed economically by conventional petroleum refining processes. These reserves typically are high-sulfur, low-gravity materials which are difficult to produce and difficult to handle after being produced.

2. The Prior Art

Several processes for producing useful products from heavy high-sulfur feedstocks have been proposed. One such process involves subjecting the material to a delayed coking operation. However, this results in a high-sulfur coke and high-sulfur byproducts, and further results in a substantial amount of high-sulfur coke fines. Thus, conventional delayed coking of heavy high-sulfur feedstocks results in a very undesirable products distribution.

It has also been proposed to process heavy high-sulfur feedstocks in a formcoking operation, followed by high temperature desulfurization of the resulting formcoke product. This provides a formcoke product which is acceptable as metallurgical coke (normally produced by coking special types of coal in coke ovens), but results in a relatively low coke yield, and produces an undesirably high amount of heavy high-sulfur byproduct which is difficult to desulfurize. Formcoking is a process in which heated carbonaceous particles are agglomerated by tumbling with a hydrocarbon binder to produce large solid particles suitable for use as metallurgical coke. Formcoking is described in detail in U.S. Pat. Nos. 3,073,751 and 3,117,918.

Various other schemes have been proposed for processing heavy high-sulfur feedstocks, but there has been a continuing need for a process which would provide an improved product distribution and which would not require exotic or unreliable techniques. Such a process is provided by the present invention.

SUMMARY OF THE INVENTION

According to the present invention, heavy high-sulfur feedstocks are heated to coking temperature and then split between a delayed coker and a formcoker. Product from both types of coker is screened, and the smaller size particles are returned to the formcoker. Larger size particles are calcined at desulfurizing temperature to produce large particles of low-sulfur coke suitable for use as metallurgical coke.

Overhead materials from both cokers are combined in a fractionator, and gas and liquid products are recovered. The bottom fraction is recycled to the coker furnace, and the other fractions are desulfurized to provide low-sulfur gas and liquid products. Sulfur from the desulfurizing units and the calciner offgas may be recovered as a product.

It is an object of the present invention to produce metallurgical quality coke, liquid and gaseous hydrocarbon products from low quality feedstocks.

It is a further object to produce a high yield of metallurgical coke without a coke fines disposal problem.

It is still a further object to produce a high yield of low-sulfur metallurgical coke and an increased amount of more easily desulfurized liquid products from a heavy high-sulfur feedstock.

It is still a further object to provide a flexible process for producing a desired product distribution which can be varied to suit demand.

Other objects and advantages of the invention will be apparent from consideration of the following detailed description of the invention.

THE DRAWINGS

The FIGURE is a schematic representation of of the process of the invention.

DESCRIPTION OF THE PREFERRED EMBODIMENTS

The most preferred embodiment of the invention, and variations thereof, will be described with reference to the FIGURE.

Heavy high-sulfur feedstocks suitable for this invention may be from any of several sources, and need not meet any rigid specifications. However, the process is especially useful for hydrocarbonaceous feedstocks having an API gravity of from $-10°$ to $+10°$, a sulfur content of at least four percent by weight and a Conradson carbon content of at least 15 percent by weight. Such feedstocks may be heavy crude oil, tar sand bitumen, petroleum residual oil, coal-derived tar or other hydrocarbonaceous material. In general, the feedstock may be of such low quality that it cannot be economically processed by conventional petroleum refining techniques.

As shown in the FIGURE, feedstock from line 10 is combined with recycle from the bottom of fractionator 12 and passed through furnace 14 where it is heated to coking temperature, such as from 860° to 950° F. The heated feedstock is then split, from 25 to 60 percent to formcoker 16 and from 75 to 40 percent going to one of delayed coke drums 18 or 20.

Delayed coke from coke drum 18 or 20 is crushed to a size of $-4$ or $-3$ inches in a crusher (not shown) and passed to screen 22.

Screen 22 separates coke product from both coking operations into product and recycle. The product, typically above two inches or three inches in diameter depending on the desired size of calcined product for use as metallurgical coke, is calcined in calciner 24 at conditions to be discussed in detail below.

The undersize or recycle particles from screen 22 are heated in formcoker heater 26 to a temperature of from 750° to 1150° F., but, preferably to about or slightly below the temperature of the liquid feed to formcoker 16. Recycle solids (char) and liquid are tumbled together in formcoker 16 to produce agglomerates. The agglomerates preferably are slightly larger than the screen openings in screen 22, although in actual practice a size range will be obtained and a part of the agglomerates will be recycled along with smaller particles of delayed coke. The recycle solids may be ground before going to heater 26 to provide optimum agglomerating characteristics.

The recycle solids to the formcoker are mostly (from about 40 to about 90 percent) delayed coke, with the remainder being undersize agglomerates from the formcoker.

Overhead vapors from formcoker 16 and delayed cokers 18 or 20 are combined in fractionator 12, and various products are separated out. Gas product from line 28 goes to sulfur recovery plant 30 where sulfur is removed and recovered.

Various other products from fractionator 12 can include naphtha, distillate and gas oil recovered through lines 32, 34, and 36 respectively. These streams are preferably desulfurized by conventional processing, such as catalytic hydrogenation in desulfurizer 38.

The bottoms fraction from fractionator 12, typically a +850° F. boiling material, is combined with feedstock to coker furnace 14.

An advantage of the process over simply coking the entire feedstock in a formcoker is that the coke yield is higher for the dual coking version of this invention, with a corresponding reduction in the amount of heavier gas oil, which is very difficult to desulfurize.

An advantage of the process over simply delay coking the entire feedstock is that the delayed coke fines are converted to useful product in the formcoker, rather than presenting a disposal problem.

Large coke particles from screen 22 are calcined at desulfurizing temperature in calciner 24. Preferably, calciner 24 is a vertical shaft kiln, as this type kiln can operate at higher temerature with lower heat losses than a rotary kiln. The calcining temperature can be from about 2650° to about 2900° F. depending on the particular product and the desired sulfur level. Generally, sulfur in the product coke must be below 1.5 percent by weight in order to be acceptable to a metallurgical coke user, and sulfur levels of about 1 percent by weight or less are more desirable. The lower sulfur levels require higher calcining temperatures, such as from 2800° to 2900° F. for most cokes.

Gases containing sulfur, both from calciner 24 and from desulfurizer 38, are processed in sulfur plant 30.

The operation may be varied to produce low-sulfur coke for making anodes for use in the aluminum industry on occasions when there is no demand for metallurgical coke. This would only require different grinding and screening conditions, and changes in the formcoker operation to produce smaller particles.

The most preferred embodiment of the invention is described in the following example.

EXAMPLE

One hundred parts of feedstock having an API gravity of −1°, a sulfur content of 9.5 percent by weight and a Conradson carbon content of 25 percent by weight is combined with 18 parts of fractionator bottoms (+860° F. cut point) and fed to a coker furnace where the combined feedstock is heated to about 900° F. The heated feedstock is split, half going to a delayed coker maintained at 65 psig with a vapor outlet temperature of 850° F., and half to a formcoker where it is sprayed on heated char comprising delayed coke and recycle formcoke. Vapors from the formcoker and delayed coker are combined and sent to a fractionator. The bottoms from the fractionator comprise the recycle feed which was combined with fresh feedstock. Gases from the fractionator pass to a sulfur plant where sulfur-free gas and sulfur are recovered. Naphtha, distillate and gas oil from the fractionator are desulfurized.

Delayed coke particles and formcoke having a particle diameter above 2 inches are calcined at 2800° F. in a vertical shaft calciner to yield, based on 100 parts fresh feed, 29 parts of metallurgical coke having a sulfur content of 1.0 percent by weight.

The foregoing description and example are intended to be illustrative of the invention rather than limiting, and numerous variations and modifications will be apparent to those skilled in the art. The invention, therefore, is intended to be defined by the appended claims.

We claim:

1. A process for making low-sulfur metallurgical coke from heavy high-sulfur hydrocarbonaceous feedstock comprising:

(a) heating said feedstock to coking temperature;
(b) passing a first portion of said heated feedstock to a delayed coking operation;
(c) passing a second portion of said heated feedstock to a formcoking operation;
(d) passing delayed coke product from said delayed coking operation and formcoke product from said formcoking operation to a screening operation;
(e) returning undersize material from said screening operation to said formcoking operation;
(f) passing overhead vapors from said coking steps to a fractionation operation;
(g) recovering gas and liquid products from said fractionation operation;
(h) combining the bottoms fraction from said fractionation operation with said feedstock as recycle; and
(i) calcining the oversize material from said screening operation at a temperature high enough to produce a calcined coke product having a sulfur content of less than 1.5 percent by weight.

2. The process of claim 1 wherein the products from said fractionation operation other than said bottoms fraction are desulfurized.

3. The process of claim 2 wherein said feedstock is a hydrocarbonaceous material having an API gravity of from −10° to +10°, a sulfur content of more than 4.0 percent by weight, and a Conradson carbon content of at least 15 percent by weight.

4. The process of claim 3 wherein from 25 to 60 percent by weight of the heated feedstock plus recycle is passed to said formcoking operation and from 75 to 40 percent by weight is passed to said delayed coking operation.

5. The process of claim 4 wherein said oversize material from said screen operation is calcined at a temperature of from 2650° to 2900° F.

* * * * *